US010190788B2

(12) United States Patent
Schnell et al.

(10) Patent No.: US 10,190,788 B2
(45) Date of Patent: Jan. 29, 2019

(54) MULTI-MODE AUTO CHANGEOVER SYSTEM

(71) Applicant: Honeywell International Inc., Morris Plains, NJ (US)

(72) Inventors: Robert J. Schnell, Plymouth, MN (US); Steven C. Nichols, Plymouth, MN (US)

(73) Assignee: Honeywell International Inc., Morris Plains, NJ (US)

( * ) Notice: Subject to any disclaimer, the term of this patent is extended or adjusted under 35 U.S.C. 154(b) by 171 days.

(21) Appl. No.: 15/209,987

(22) Filed: Jul. 14, 2016

(65) Prior Publication Data

US 2016/0320086 A1 Nov. 3, 2016

Related U.S. Application Data

(63) Continuation of application No. 13/843,476, filed on Mar. 15, 2013, now Pat. No. 9,551,501.

(51) Int. Cl.

| | |
|---|---|
| ***F24F 11/00*** | (2018.01) |
| ***F24F 11/30*** | (2018.01) |
| ***F24F 11/62*** | (2018.01) |
| *F24F 110/10* | (2018.01) |
| *F24F 11/65* | (2018.01) |
| *F24F 11/52* | (2018.01) |

(52) U.S. Cl.

CPC ..... *F24F 11/0012* (2013.01); *F24F 11/30* (2018.01); *F24F 11/62* (2018.01); *F24F 11/52* (2018.01); *F24F 11/65* (2018.01); *F24F 2110/10* (2018.01)

(58) Field of Classification Search

CPC ..... F24F 11/0012; F24F 11/30; F24F 11/52; F24F 11/62; F24F 11/65; F24F 2110/10

USPC ..... 236/1 C

See application file for complete search history.

(56) References Cited

U.S. PATENT DOCUMENTS

| | | | | |
|---|---|---|---|---|
| 3,815,668 | A | 6/1974 | Carlson | |
| 3,825,852 | A | 7/1974 | Pinckaers | |
| 4,071,745 | A | 1/1978 | Hall | |
| 4,177,860 | A | 12/1979 | Johnson et al. | |
| 4,316,256 | A | 2/1982 | Hendricks et al. | |
| 4,386,649 | A * | 6/1983 | Hines | G05D 23/1904 165/239 |
| 4,420,736 | A | 12/1983 | Krueger | |

(Continued)

OTHER PUBLICATIONS

Ambient Electrical Ltd., "TR3100 Thermostat Instructions," Version 1.3, 2 pages, prior to Mar. 15, 2013.

(Continued)

*Primary Examiner* — Marc Norman

(74) *Attorney, Agent, or Firm* — Shumaker & Sieffert, P.A.

(57) ABSTRACT

An auto changeover mechanism for a thermostat. A heat and cool mode auto changeover with single or crossed setpoints may be an approach for doing a single setpoint auto changeover, an approach that can handle auto changeover with separate heat and cool setpoints that do not require the cool setpoint to always be higher than the heat setpoint, and also an approach that does not necessarily require a dead band between the setpoints. A hysteresis may be associated with switching to the other mode. The thermostat having the auto changeover mechanism may have a display of a mode that automatically changes between heat and cool.

18 Claims, 13 Drawing Sheets

(56) References Cited

U.S. PATENT DOCUMENTS

| | | | | |
|---|---|---|---|---|
| 4,446,913 | A | 5/1984 | Krocker | |
| 4,632,177 | A | 12/1986 | Beckey | |
| 4,799,176 | A | 1/1989 | Cacciatore | |
| 5,154,226 | A | 10/1992 | Porter et al. | |
| 5,192,020 | A | 3/1993 | Shah | |
| 6,681,848 | B2 | 1/2004 | Breeden | |
| 7,556,207 | B2 | 7/2009 | Mueller et al. | |
| 7,641,126 | B2 | 1/2010 | Schultz et al. | |
| 7,802,618 | B2 | 9/2010 | Simon et al. | |
| 7,861,941 | B2 | 1/2011 | Schultz et al. | |
| 8,091,794 | B2 | 1/2012 | Siddaramanna et al. | |
| 2005/0189429 | A1 | 9/2005 | Breeden | |
| 2007/0045444 | A1 | 3/2007 | Gray et al. | |
| 2007/0138308 | A1 | 6/2007 | Schultz et al. | |
| 2009/0140064 | A1* | 6/2009 | Schultz | F24F 11/006 236/51 |
| 2012/0006756 | A1 | 1/2012 | Correa | |
| 2012/0061068 | A1 | 3/2012 | Anderson et al. | |
| 2012/0067561 | A1 | 3/2012 | Bergman et al. | |
| 2013/0263034 | A1* | 10/2013 | Bruck | F24F 11/0086 715/771 |
| 2014/0263678 | A1 | 9/2014 | Schnell et al. | |

OTHER PUBLICATIONS

Aube Technologies, "TH232-AF-230 Installation Instructions, 230 V Base," pp. 1-4, May 26, 2010.

Honeywell, "TB6575/TB8575 SuitePro Digital Fan Coil Thermostats," Installation Instructions, 20 pages, Apr. 2010.

Zennio, "Zennio "Building" Thermostat," Version 1.1 Document Edition a, 37 pages, prior to Mar. 15, 2013.

* cited by examiner

MULTI-MODE AUTO CHANGEOVER SYSTEM

This present application is a Continuation of U.S. patent application Ser. No. 13/843,476, filed Mar. 15, 2013. U.S. patent application Ser. No. 13/843,476, filed Mar. 15, 2013, is hereby incorporated by reference.

BACKGROUND

The present disclosure pertains to thermostats and particularly to mode changes between heat and cool of thermostats.

SUMMARY

The disclosure reveals an auto changeover mechanism for a thermostat. A heat and cool mode auto changeover with single or crossed setpoints may be an approach for doing a single setpoint auto changeover, an approach that can handle auto changeover with separate heat and cool setpoints that do not require the cool setpoint to always be higher than the heat setpoint, and also an approach that does not necessarily require a dead band between the setpoints. A hysteresis may be associated with switching to the other mode. The thermostat having the auto changeover mechanism may have a display of a mode that automatically changes between heat and cool.

DESCRIPTION

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

A heat cool auto changeover with single or crossed setpoints may be an approach for doing single setpoint auto changeover and also an approach that can handle auto changeover with a separate heat setpoint (SP) and cool setpoint that do not require the cool setpoint to be higher than the heat setpoint, and an approach that does not necessarily require a minimum dead band between the two setpoints.

The present approach may vastly simplify how setpoint scheduling is done. The approach does not necessarily require setpoint pairs with complex rules (from a user's perspective) about position and closeness of the heat setpoint and cool setpoint.

Some thermostats that have an auto changeover may always force the cool setpoint to be above the heat setpoint, and also enforce a minimum "deadband" distance between them. The cool and heat setpoints of those thermostats generally could not necessarily be closer than 3 (or 2) degrees apart.

Some thermostats having an auto changeover often have to stay in a heat mode until the space temperature rises up to the cool setpoint and then they can switch to cool mode. Those thermostats may stay in a cool mode until the space temperature drops down to the heat setpoint and then it can switch to the heat mode.

The present approach may perform auto changeover without regard to the relationship or distance between the heat and cool setpoints.

Figure 1:
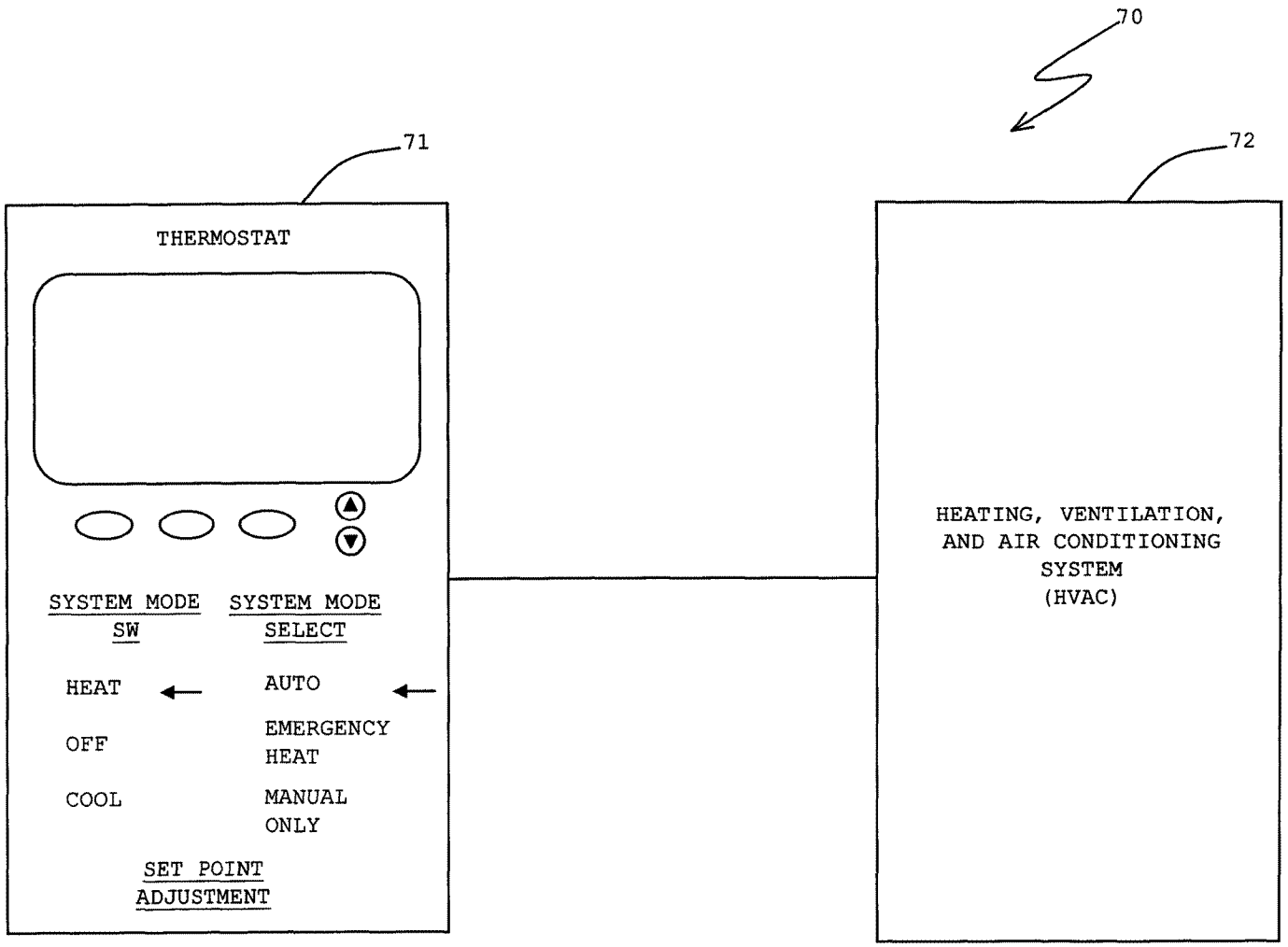
FIG. 1 is a diagram of a thermostat with an auto changeover and other items for controlling a heating, ventilation and air conditioning system.

FIG. 1 is a diagram of a system 70 having a thermostat 71 with an auto changeover and other items for controlling a heating, ventilation and air conditioning system 72. Thermostat 71 may have a system mode switch with positions of "heat", "cool" and "system". Thermostat 71 may have a system mode select with positions of "auto", "emergency heat" and "manual only".

An auto changeover mechanism of system 70 may be noted. Thermostat 71 may internally determine a heat switchover and a cool switchover temperature. The heat switchover temperature may be either 1.5 deg F. below the cooling setpoint or equal to the heating setpoint, whichever is lower. This may be the trigger temperature below at which the system switch changes to heat. The cool switchover temperature may be either 1.5 deg F. above the heat setpoint or equal to the cool setpoint, whichever is higher. This may be the trigger temperature above which the system switch changes to cool.

Figure 2:
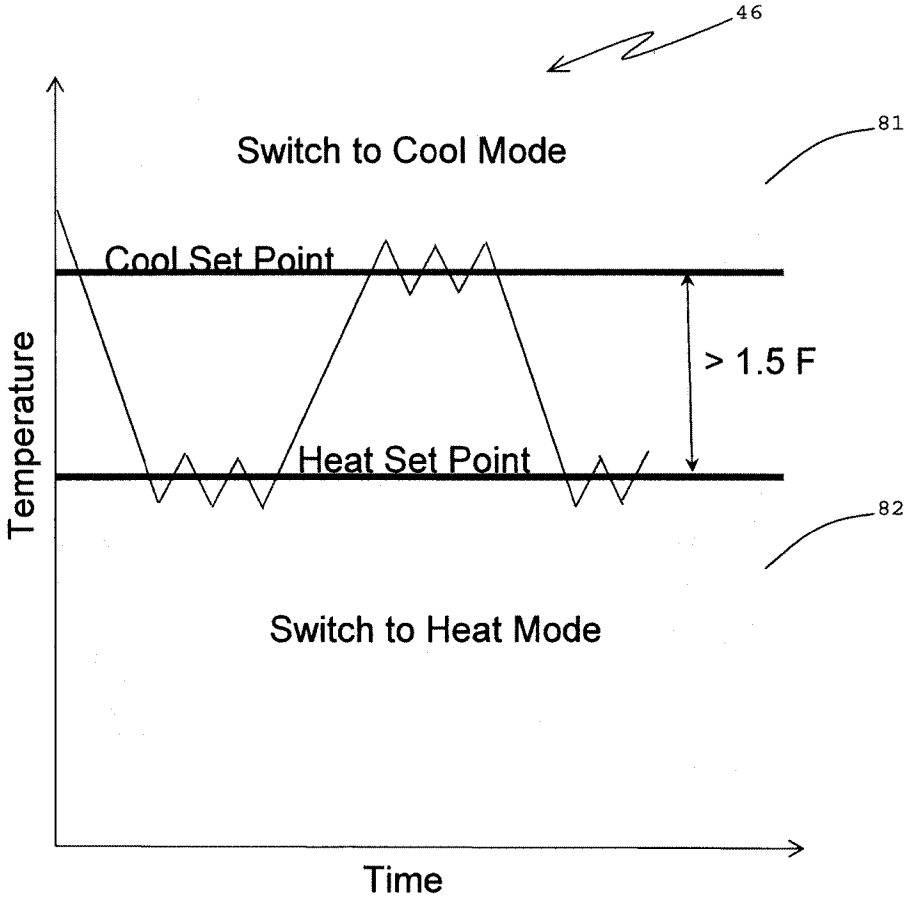
FIGS. 2-5 are diagrams of graphs illustrating behavior of a thermostat, having an auto changeover mechanism, relative to heat and switchover temperatures in view of space temperature, and particular heat and cool setpoints.

When the cool setpoint is more than 1.5 deg F. above the heat setpoint, the behavior may be the same as an auto changeover mechanism with a 1.5 deg F. difference, as illustrated in a graph 46 of FIG. 2. When a building or space temperature reaches an area or zone 81, a switch to a cool mode may occur. When the temperature reaches an area or zone 82, a switch to a heat mode may occur.

Figure 3:
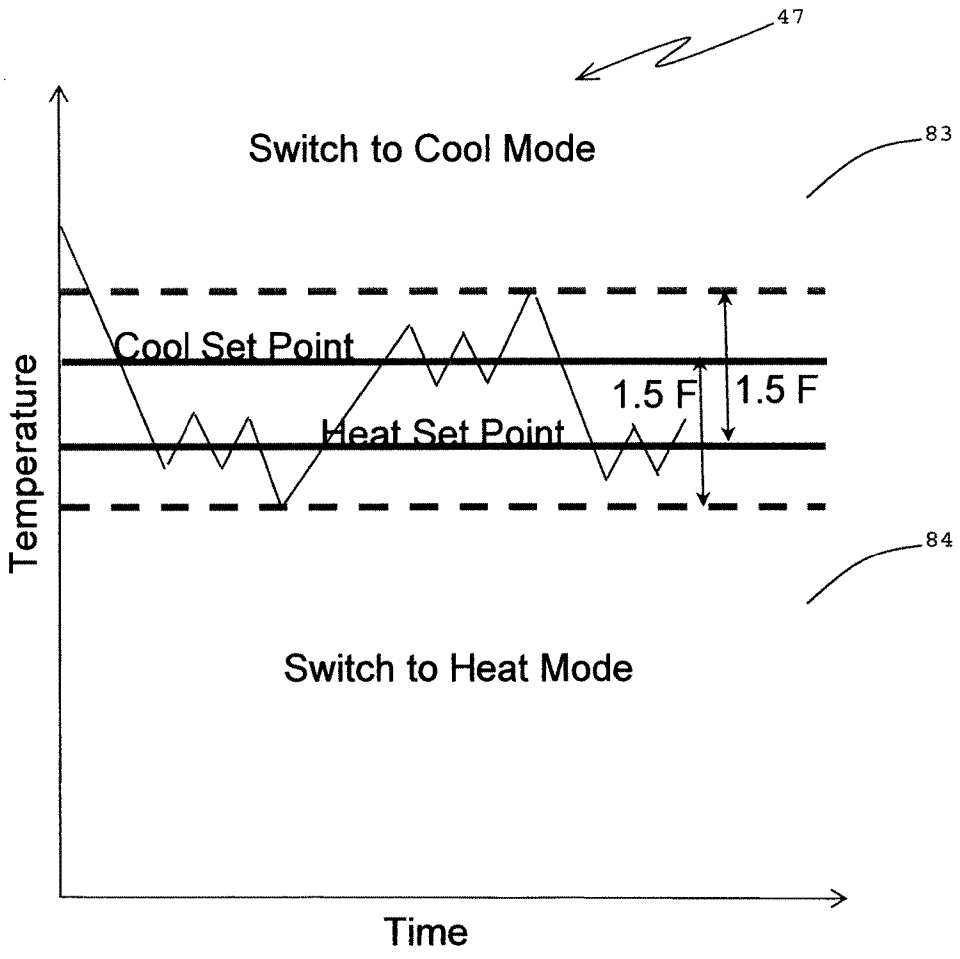

A graph 47 in FIG. 3 may illustrate the behavior when the cool setpoint is above the heat setpoint, but the difference can be less than 1.5 deg F. When the temperature reaches an area 83, a switch to the cool mode may occur. When the temperature reaches an area 84, a switch to the heat mode may occur. When a building or space temperature reaches an area or zone 83, a switch to a cool mode may occur after a given period of time. When the temperature reaches an area or zone 84, a switch to a heat mode may occur after a given period of time. The periods of time may be different for each zone and vary from zero to virtually any number of minutes. The time period amounts may be dynamic in that they can change over time. A hysteresis may be the amount of temperature difference between a setpoint and its corresponding area or zone that a space temperature reaches to effect a switch or change in mode.

Figure 4:
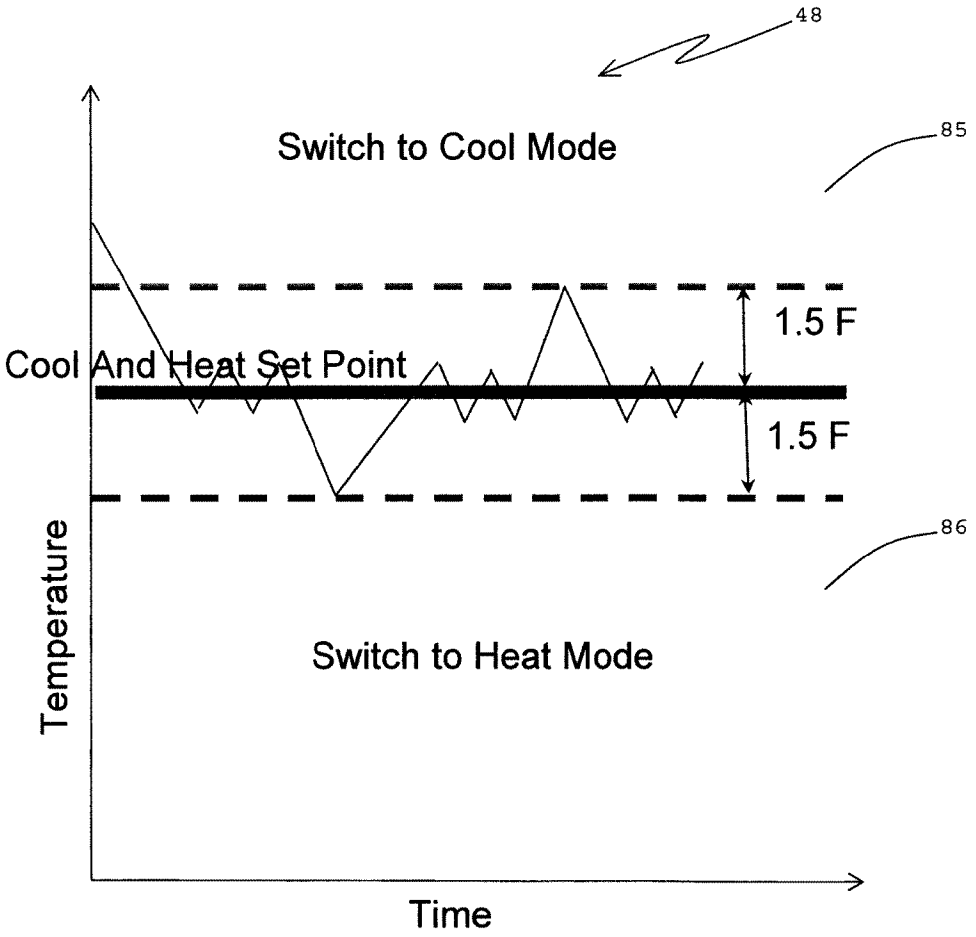

A graph 48 in FIG. 4 may illustrate the behavior when the cool and heat setpoints are the same. When the temperature reaches an area 85, a switch to the cool mode may occur. When the temperature reaches an area 86, a switch to the heat mode may occur. When a building or space temperature reaches an area or zone 85, a switch to a cool mode may occur after a given period of time. When the temperature reaches an area or zone 86, a switch to a heat mode may occur after a given period of time. The periods of time may be different for each zone and vary from zero to virtually any number of minutes. The time period amounts may be dynamic in that they can change over time.

Figure 5:
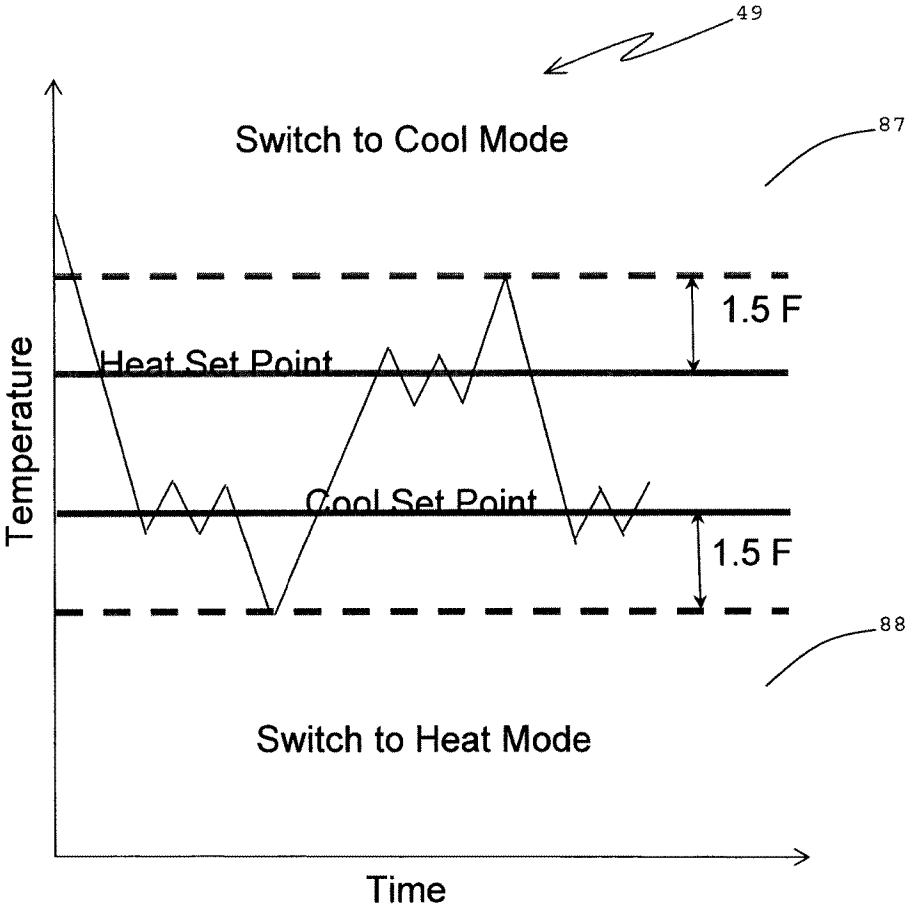

A graph 49 in FIG. 5 may indicate the behavior when the cool setpoint is below the heat setpoint. When the temperature reaches an area 87, a switch to the cool mode may occur. When the temperature reaches an area 88, a switch to the heat mode may occur. When a building or space temperature reaches an area or zone 87, a switch to a cool mode may occur after a given period of time. When the temperature reaches an area or zone 88, a switch to a heat mode may occur after a given period of time. The periods of time may be different for each zone and vary from zero to virtually any number of minutes. The time period amounts may be dynamic in that they can change over time.

Figure 6:
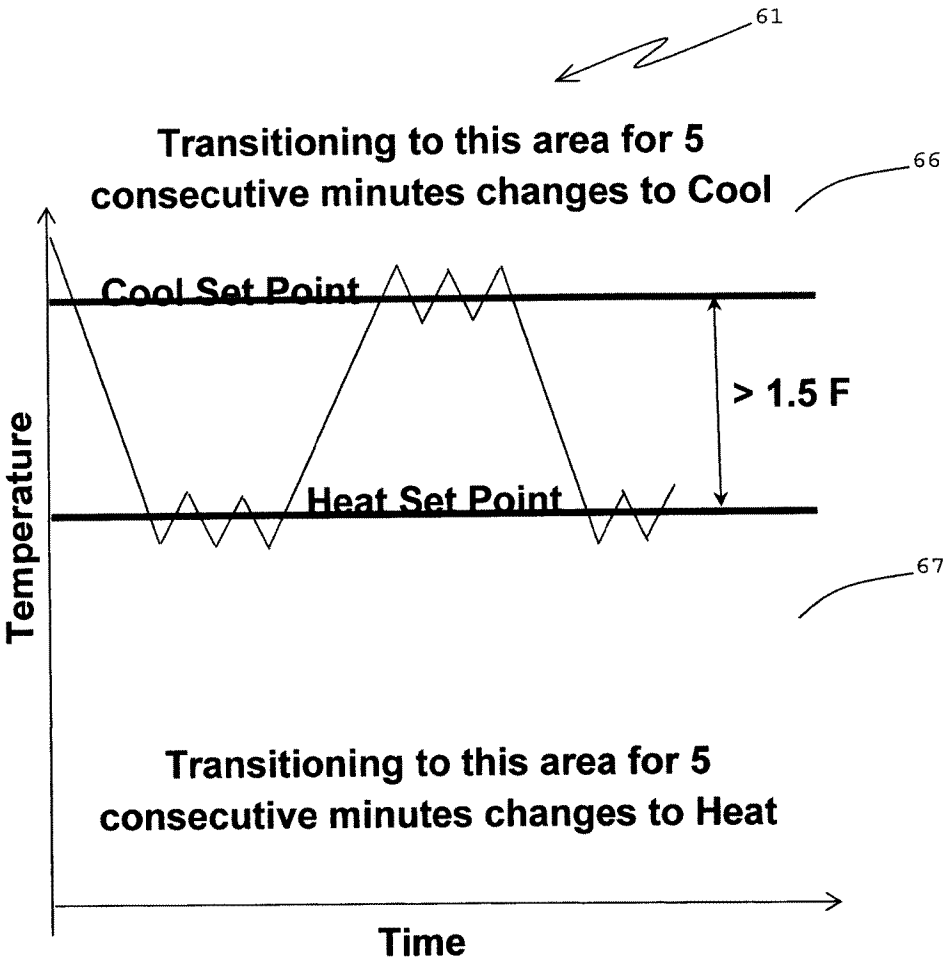
FIGS. 6-9 are diagrams of graphs illustrating behavior of a thermostat, with a transitioning time in switching areas, having an auto changeover mechanism, relative to heat and switchover temperatures in view of space temperature, and particular heat and cool setpoints.

FIG. 6 is a graph 61 that shows a behavior when the cool setpoint may be greater that 1.5 degrees F. above the heating setpoint. Transitioning to an area or zone 66 above the cool setpoint or an area or zone 67 below the heat setpoint may occur for a period of time (e.g., 5 consecutive minutes) and change the mode to cool or heat, respectively. The period of time for transitioning may be other than five consecutive minutes. The periods of time may be different for each zone and vary from zero to virtually any number of minutes or other units of time. The time period amounts may be dynamic in that they can change over time in the behavior examples of present graph 61 and graphs 62-64 noted herein.

Figure 7:
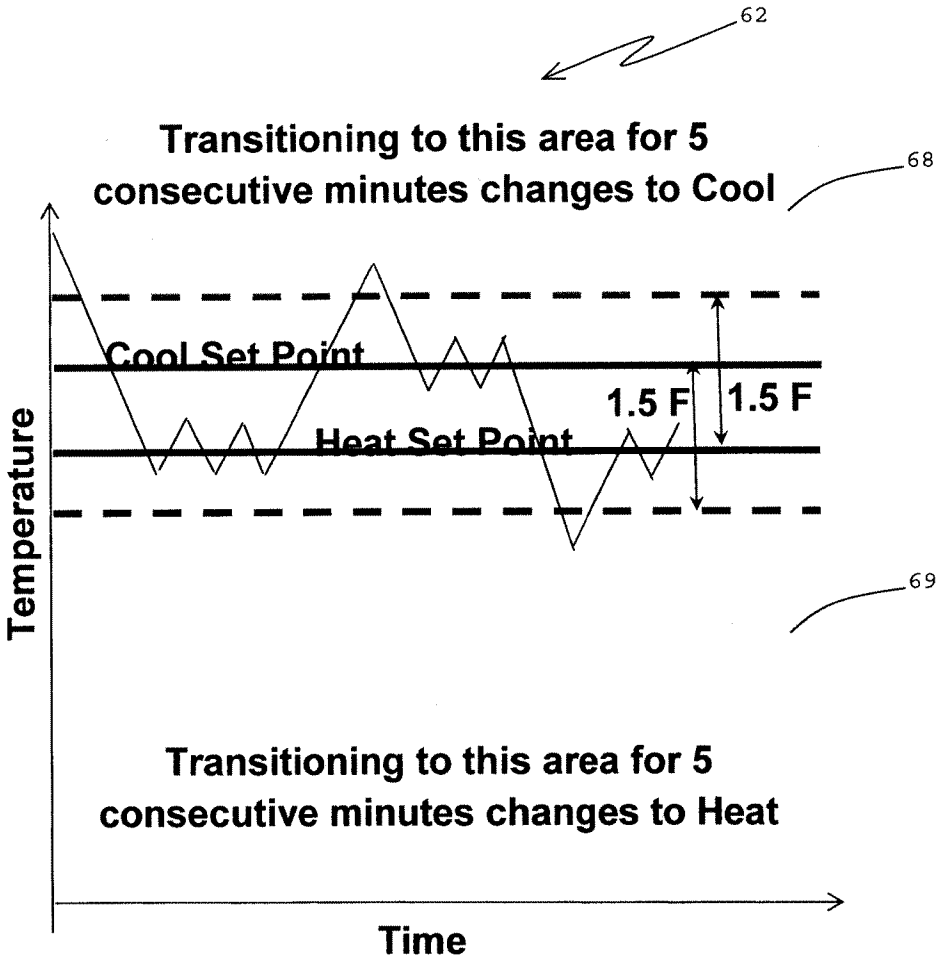

FIG. 7 is a graph 62 that shows a behavior when the cool setpoint is above the heat setpoint less than 1.5 degrees F. Transitioning to an area 68 above the cool setpoint or an area 69 below the heat setpoint may occur for a period of time (e.g., 5 consecutive minutes) and change the mode to cool or heat, respectively.

Figure 8:
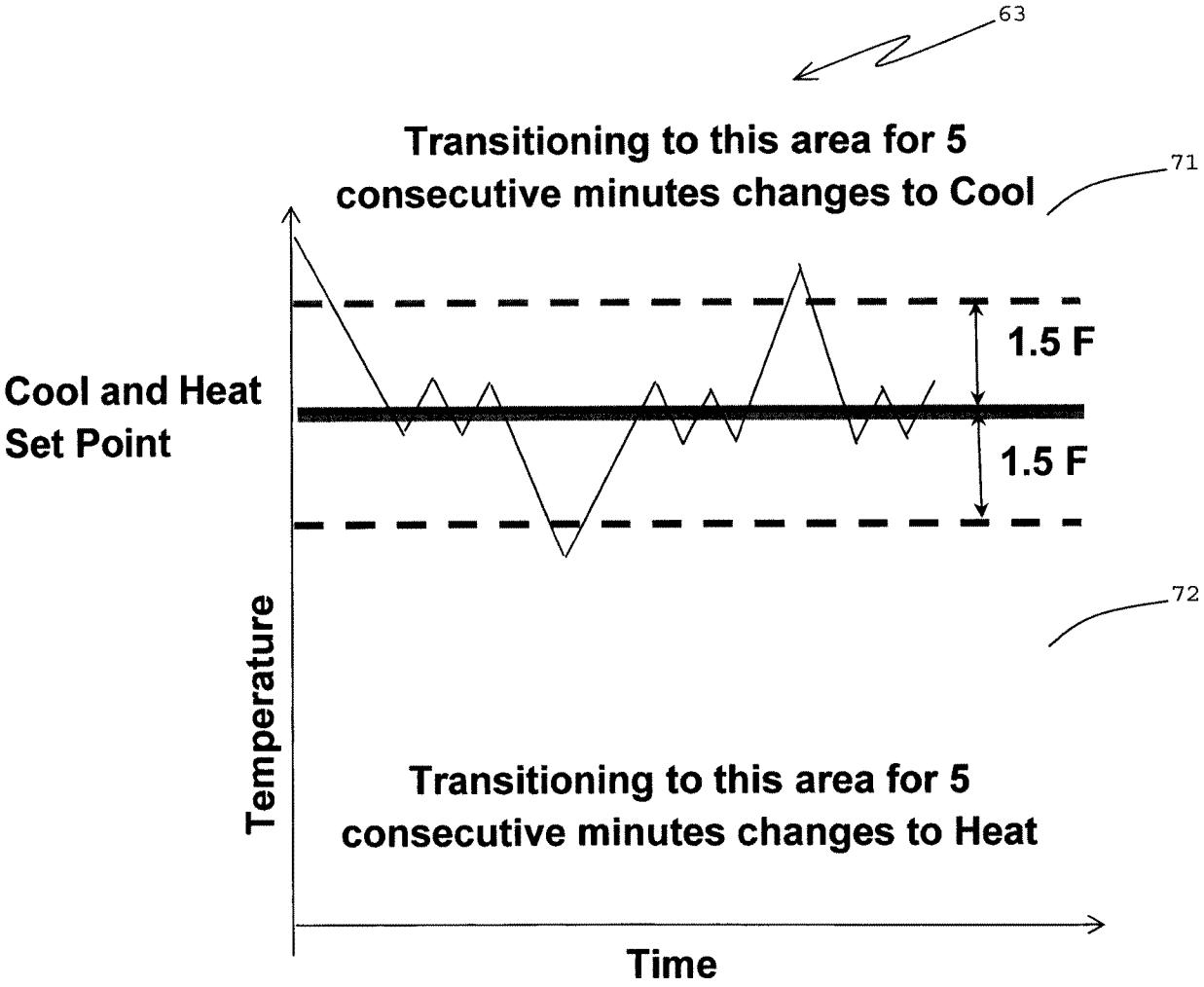

FIG. 8 is a graph 63 that shows a behavior when the cool and heat setpoints are the same. Transitioning to an area 71 above the cool setpoint or an area 72 below the heat setpoint may occur for a period of time (e.g., 5 consecutive minutes) and change the mode to cool or heat, respectively.

Figure 9:
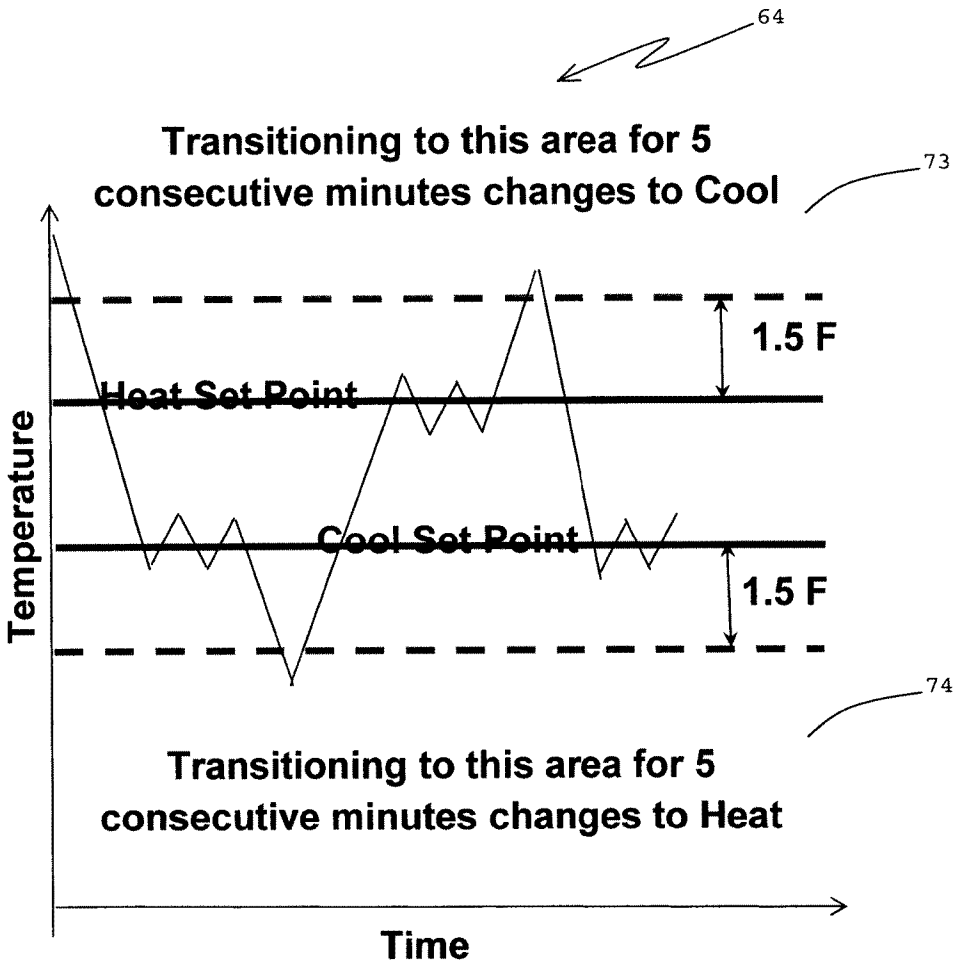

FIG. 9 is a graph 64 that shows a behavior when the cool setpoint is below the heat setpoint. Transitioning to an area 73 above the cool setpoint or an area 74 below the heat setpoint may occur for a period of time (e.g., 5 consecutive minutes) and change the mode to cool or heat, respectively. The period of time for transitioning may be other than five consecutive minutes in the behavior examples of graphs 61-64.

When a cool setpoint is above a heat setpoint by at least 1.5 degrees F., then the present auto changeover may work the same as ordinary logic, it can switch from heat mode to cool mode when the space temp is at or above the cool setpoint, and it can switch from cool mode to heat mode when the space temp is at or below the heat setpoint.

Several cases may be noted. One case may be when the cool setpoint is above the heat setpoint by less than 1.5 degrees F. Another case may be when the cool setpoint is equal to the heat setpoint (this may be same as a single setpoint auto changeover). Still another way may be when the cool setpoint is below the heat setpoint.

The auto changeover may switch from heat mode to cool mode when the space temp is 1.5 degrees or more above the heat setpoint and it may switch from cool mode to heat mode when the space temp is 1.5 degrees or more below the cool setpoint.

If the mode is unknown, then if the space temp is below both the heat and cool setpoints the auto changeover may start in a heat mode, or then if the space temp is above both the heat and cool setpoints the auto changeover may start in a cool mode, or if the space temp is between the heat and cool setpoints the auto changeover may start in the mode of whichever setpoint is closest to the space temp.

It may be noted that emergency heat is not necessarily part of the system switch. The user may activate/deactivate emergency heat by toggling an "Emergency Heat" button on the app secondary card. When activating Emergency Heat, the system switch may automatically change to Heat and auto changeover may be automatically deactivated. When activating auto changeover, emergency heat may be automatically deactivated. When the system switch changes to Cool or Off, emergency heat may be automatically deactivated. At the thermostat, the user cannot necessarily tell whether emergency heat has been activated.

People may generally prefer a different temperature setpoint in the summer versus winter. Consequently, thermostats may have implemented separate temperature setpoints for heating versus cooling. Some thermostats may also have a selectable system mode with allowed positions of Heat, Off, Cool, and Auto, where in the Auto position, the thermostat may automatically change between controlling to the heating setpoint and cooling setpoint as noted therein. Even though there are separate heating and cooling temperature setpoints, many thermostat users may prefer to see only one setpoint. In some thermostats when the system mode is in the Heat position, it may show and allow adjustment of the heating setpoint and when in the Cool position it may show and allow adjustment of the cooling setpoint. When the system mode is in the Off position, neither temperature setpoint is necessarily shown and neither can necessarily be adjusted. The user may choose which temperature setpoint to adjust by choosing the system mode position. However, when the system mode of such thermostats is in the Auto position, they may show both the heating and cooling setpoints and make the users to choose which ones they are adjusting.

In contrast, the present approach may improve on the thermostats by allowing the user interface to show only one setpoint even when the thermostat automatically chooses between heating and cooling. Auto may be removed from the system mode position. Instead, Auto may become an independent on/off parameter set by the user. When Auto is set to "On", the thermostat may automatically choose between controlling the heating or cooling setpoints, and in doing so also change the system mode position between Heat and Cool.

Like some thermostats, when in the Heat or Cool position, the respective temperature setpoint may be shown and be changed, and when in the Off position, neither temperature setpoint is necessarily shown and neither can necessarily be adjusted. The user may manually change the automatically chosen system mode position, which may create an override to Auto. Auto may eventually reinstate itself, either after a timeout, a retrigger of the conditions that cause switching between heating and cooling, or a manual retrigger.

There may be a thermostat with one-touch actions and scheduling. A basic interaction model may be at a wall. The model may have a Set Point Adjustment, Away Mode Activation/Cancel, System Switch Adjustment, and not necessarily anything else.

Figure 10:
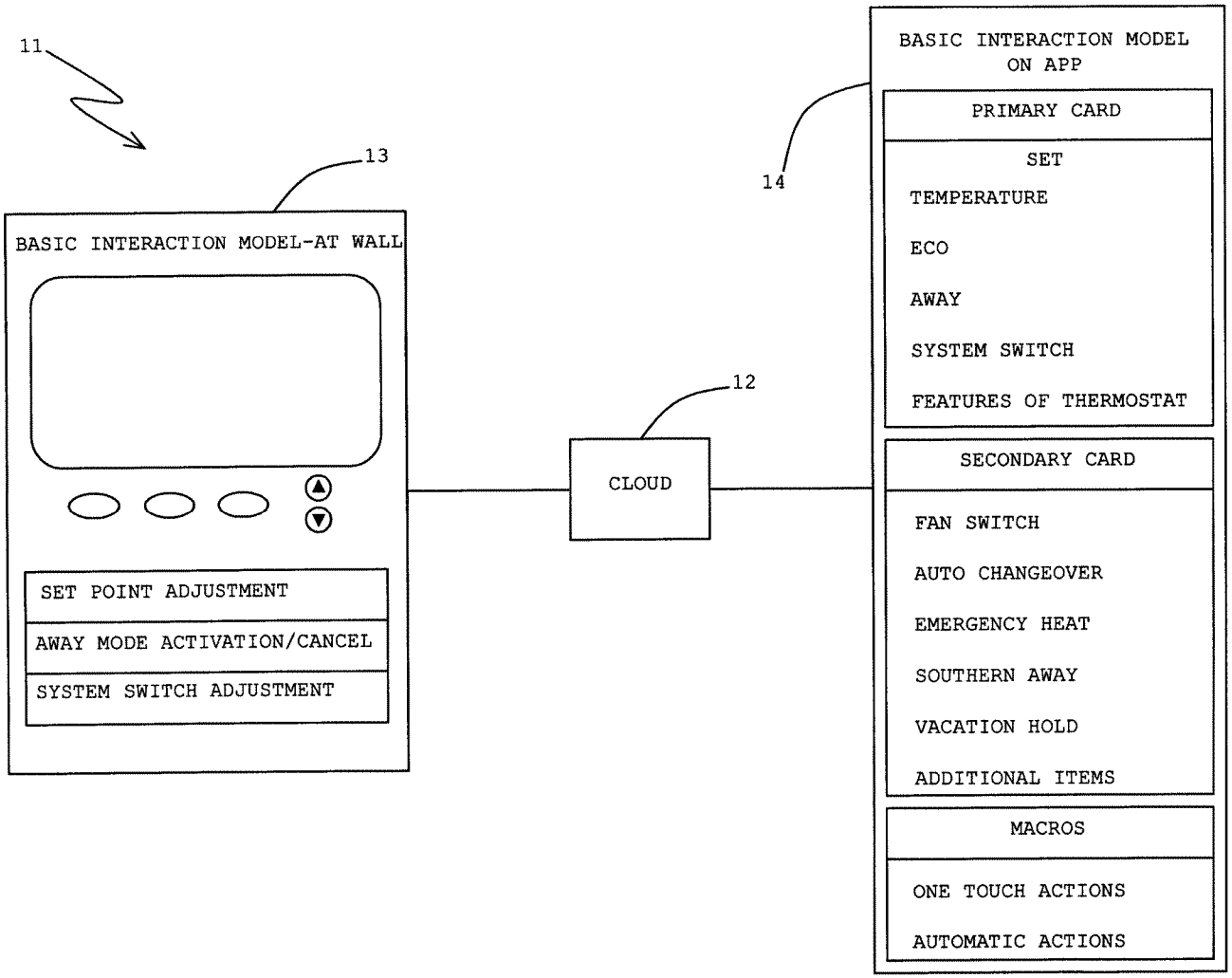
FIG. 10 is a diagram of a system having a cloud, a basic interaction model at a wall, and a basic interaction model on an application.

FIG. 10 is a diagram of a system 11 having a cloud 12, a basic interaction model 13 at a wall, and a basic interaction model 14 on an application (on app). There may be some instances no cloud 12 in system 11.

Automatic actions may be time based (or temporal) events which may be one time or recurring. There may be options for recurring that go from simple (like an iPhone alarm) to complex (like a Google Calendar or Yahoo Calendar).

Figure 11:
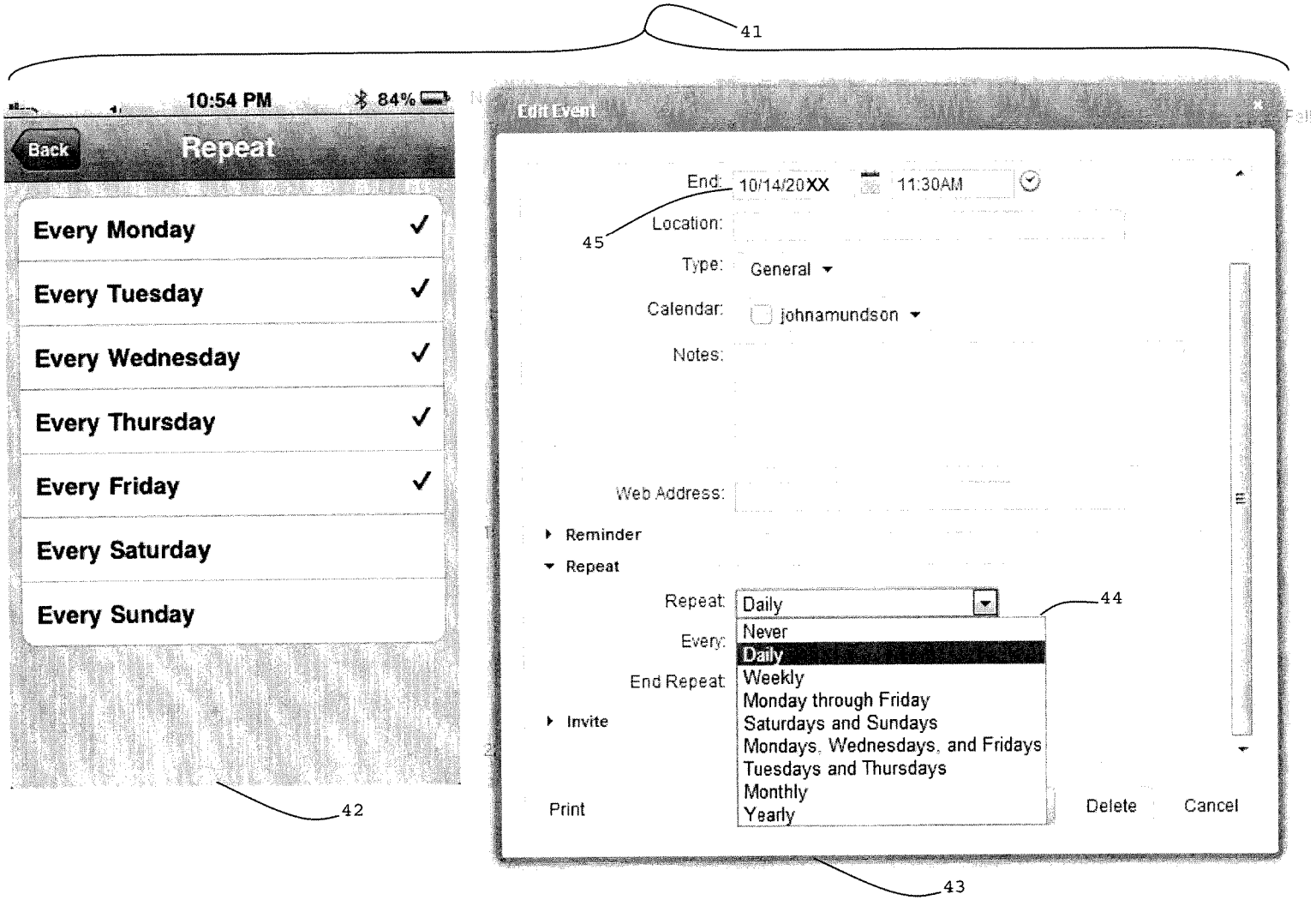
FIG. 11 is a diagram of screens that may be used in selecting times for events.

FIG. 11 is a diagram of screens 41 that may be used in selecting times for events. Screen 42 may indicate the days of the week that an event is to repeat. Screen 43 has a drop down menu 44 for selecting the kind of recurrence of events that is desired. Box 45 may indicate how long the selection of menu 44 should continue.

Figure 12:
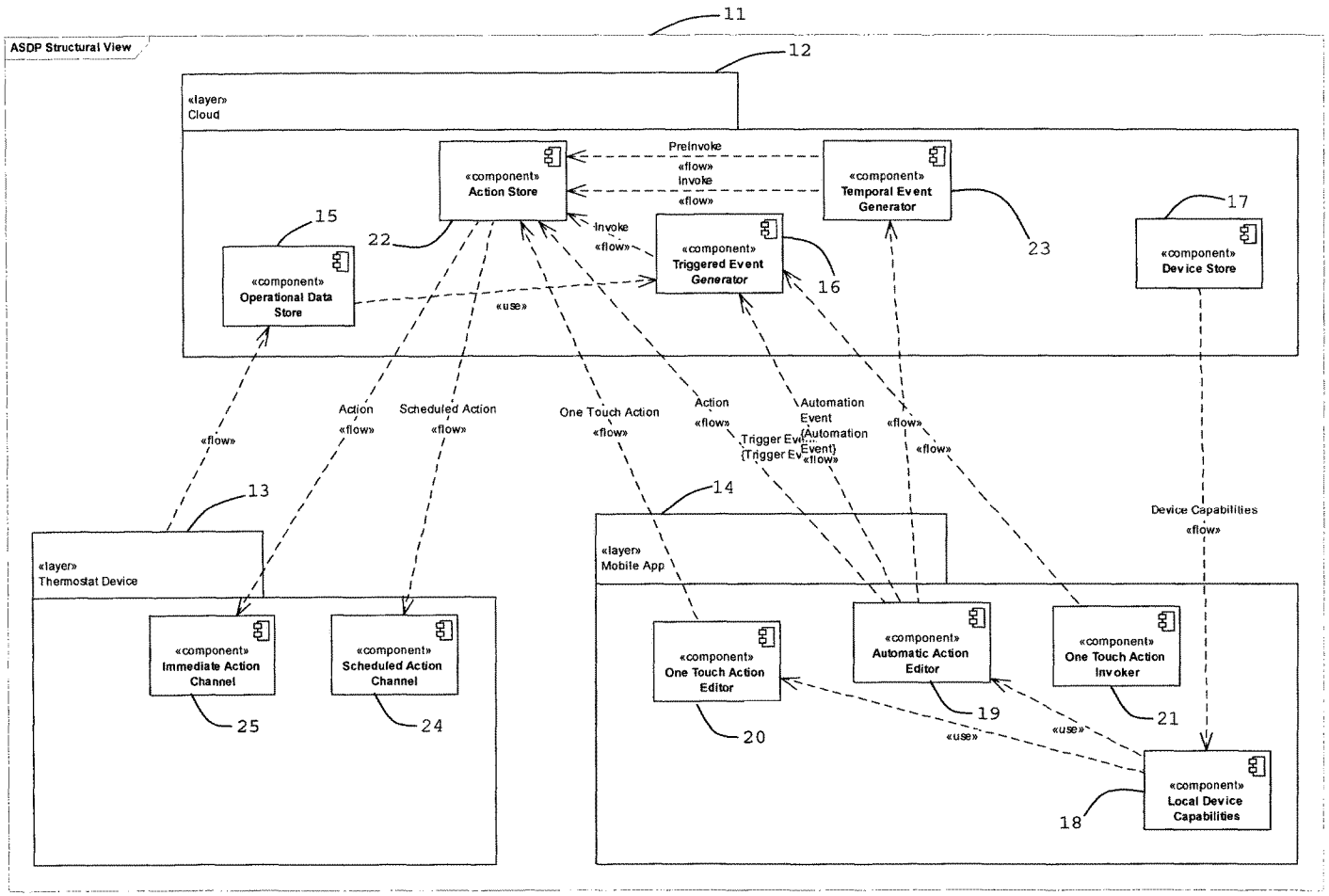
FIG. 12 is a more detailed diagram of system of FIG. 10.

FIG. 12 is a more detailed diagram of system 11 which may be referred to as an event based schedule structural view 11. There may be cloud 12, the basic interaction model at the wall referred to as a thermostat (stat) device 13 and the basic interaction model on the application referred to as a mobile application (app) 14. There may be a flow from thermostat device 13 to an operational data store 15 of cloud 12. A use may be from operational data store 15 to a triggered event generator 16. There may be a flow of device capabilities from a device store 17 to local services capabilities 18 of mobile app 14. A use may be from local services capabilities 18 to an automatic action editor 19 and one touch editor 20. A flow may go from a one touch action invoker 21 to triggered event generator 16. The may be a flow of an automation event and a trigger event from automatic action editor 19 to triggered event generator 16. There may be a flow of action from automatic action editor 19 to an action store 22 of cloud 12. There may be a flow from automatic action editor 19 to a temporal event generator 23. There may be a pre-invoke flow and an invoke flow from temporal event generator 23 to action store 22. There may be a one touch action flow from one touch action editor to action store 22. There may be a scheduled action flow from action store 22 to a scheduled action channel 24. An action flow may go from action store 22 to an immediate action channel 25 of thermostat 13.

Figure 13:
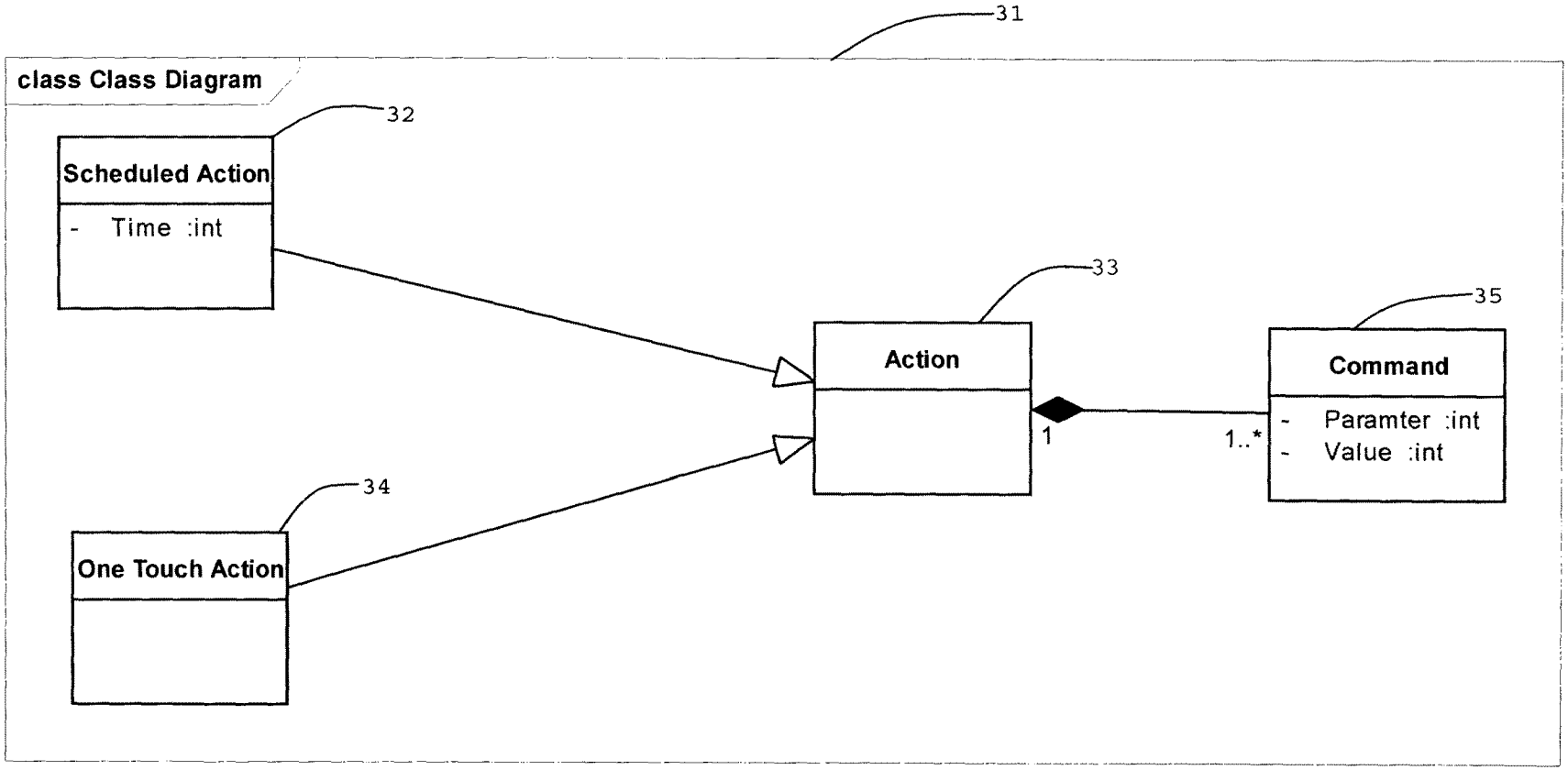
FIG. 13 is diagram of an actions class view.

FIG. 13 is diagram of an actions class view 31. A scheduled action unit 32 may have an output connected to an action unit 33. A one touch action unit 34 may have an output connected to action unit 33. A command unit 35 may be connected to action unit 33.

A basic interaction model app 14 (FIG. 10) may have the following cards and macros. A primary card may provide for setpoints of Temperature, Eco, Away, and System Switch. The card may also have the same features as a thermostat.

A secondary card may provide for a Fan Switch, Auto Changeover, Emergency Heat, Southern Away, Vacation Hold, and possibly other items.

Macros may incorporate one touch actions. A one touch action may be a user-defined set of operations to be carried out across one or more devices at a press of a button. One may pre-populate some of the one touch actions (e.g., "My Temp", "I'm Leaving", "Go to Bed"). As to automatic actions, virtually any of the one touch actions may be automated. Automation may include time based and triggered events.

As to one touch actions, one may cross multiple systems and multiple locations in a connected home. Examples may include a thermostat, security system, garage door, door locks, lighting, and so forth. One may actuate multiple device specific actions at the press of a button. For Example, with "My Temp", one may set the main thermostat heating setpoint=72 F, set the main thermostat cooling setpoint=78 F, and set the main thermostat Away Mode=Not Away.

Examples of triggered events may involve doing a one touch action "My Temp" when one's security system transitions to "unarmed". One may move the system switch to "Heat" when the outdoor temperature drops below 55 F.

An automatic action may be an (time or trigger)/(optional enable condition)/(action list) entity. An example may involve a trigger of an outside temperature less than <55 F, an enable condition of time between 3:00 PM and 10:00 PM, and an action list of system switch=Heat, fan switch=On.

Automatic actions may be like one touch actions except when they have a time or trigger, and optionally an enable condition. Triggers and enable conditions should be evaluated to be either True or False.

Automatic actions may be time based (temporal). Examples may include Time: 5:00 PM weekdays, action list: AwayMode=Not Away; and Time: 9:00 AM weekends, action list: AwayMode=Not Away. The times may be based on local time, not UTC time.

Automatic actions may be triggered. An example may include Trigger: the front door=unlocked, action list: AwayMode=Not Away As to time based automatic actions, only specific times may be allowed. Examples allowed may include: 3:00 PM; 3:00 PM Mondays; 3:00 PM Weekdays; and 3:00 PM Oct. 17, 20XX. Examples not allowed may include indefinite times such as before 3:00 PM; after 3:00 PM; and between 3:00 PM and 4:00 PM.

Triggered automatic actions may be noted. When a trigger changes from False to True, then the action list may be executed. For example, Trigger=outside temperature <55 F, action list=fan switch=On. The fan switch may be set to On when the outside temperature is 55 F or above and then may change to below 55 F. Once executed, to execute the action list again, the trigger needs to change back to False and then to True. If the trigger uses a parameter that is not enumerated, then a small amount of hysteresis may have to be implemented. The amount of hysteresis needed may be parameter dependant. In an example, the outside temperature may need to change to greater than or equal to 55 F (+hysteresis) and then below 55 F to be retriggered.

As to automatic actions, the user may manually change parameters (i.e., the setpoints) virtually any time, and consider them overrides to the automatic actions. The overrides may persist until an associated automatic action is triggered.

The app may have a "Do All Automatic Actions" button. The button may execute virtually all trigger based automatic actions. Those triggers that evaluate to True may cause their action list to be executed. The button may give the user an ability to cancel overrides of trigger based automatic actions. The user does not necessarily have an ability to reinstate time based automatic actions.

Some automated actions may be complicated to some extent. Complicated conditions may be difficult to view/edit on a smart phone. One may not want to necessarily allow AND/OR logic, an ELSEIF, ELSE format, a parenthesis grouping, or time based and non-time based in the same condition. An example may be a trigger: the outdoor temperature is below 55 F at 5:00 PM, action list: system switch=Heat. There may be logic conflicts. An example of conflict may be trigger: outdoor temperature <55 F, action list: system switch=Heat and trigger: outdoor temperature <55 F, action list: system switch=Cool. It may be recommended that the user not necessarily be allowed to set automated actions that have conflicts. To resolve conflicts, one may recommend the last executed wins.

One may want to prevent infinite loops. To allow looping and/or branching is not necessarily recommended. Having actions reference other actions may be recommended. Actions causing trigger loops may be prevented. For example, an infinite loop may be involve an AutoAction#1—trigger: heat setpoint >70 F, action list: heat setpoint=69 F, and an AutoAction#2—trigger: heat setpoint <70 F, action list: heat setpoint=71 F. Initially, one should not permit the set of parameters allowed to be conditions that overlap the set of parameters allowed to be actions (allow heat setpoint to be used in actions but not triggers). Later on, one may remove the restriction and detect one or more infinite loops and prevent them from running and alert the user. Also later on, the user should be prevented from creating infinite loops A present setpoint model may be noted. There may be separate heat and cool setpoints. The user does not necessarily associate setpoints with an Away mode. Internally, the thermostat may implement values that prevent frozen pipes and melting candles. The thermostat and app do not necessarily show a setpoint and allow the user to manually change the setpoint when in the Away mode. Setpoints may apply only to Not Away modes (Eco and Not Eco). When changing to an Away mode, the thermostat may remember the heat and cool setpoints and reinstate them when changing back to the Not Away mode. When automatic actions change the heat and/or cool setpoints, the values may apply only for the Not Away mode. Automatic actions may change the setpoints when in the Away mode, but the new values do not necessarily take effect until the mode changes to Not Away.

System switch modes may be Heat, Cool, and Off. The modes may be on the thermostat and on the app. Auto may be implemented separately from a system switch. Emergency Heat may be implemented separately from the system switch.

On the thermostat or app, only one setpoint, whether cool or heat, may generally be shown when showing the setpoint. On the thermostat or app primary card, when the system switch is on at Heat, then the heat setpoint may be shown when showing a setpoint. The heat setpoint may be modified when manually changing the setpoint. When the system switch is on at Cool, then the cool setpoint may be shown when showing a setpoint. The cool setpoint may be modified when manually changing the setpoint. When the system switch is at Off, then no setpoint is shown and the setpoints cannot necessarily be manually changed.

When creating one touch actions or automatic actions that change the setpoint, the user should specifically indicate whether the heat setpoint and/or the cool setpoint is being set. Examples may include: Time: 6:00 AM weekdays, action list: heat setpoint=72 F, cool setpoint=78 F; and Time: 9:00 AM weekend, action list: heat setpoint=72 F, cool setpoint=78 F.

An auto changeover may be noted. Some features of the changeover may incorporate the following items. No dead band is necessarily required. Heating setpoints may be below, equal to, or above cooling setpoints. There may be no installer setup (ISU) to allow/disallow an auto changeover. An auto changeover may virtually always be allowed. The auto changeover is not necessarily a part of the system switch. The user may activate and deactivate by toggling an "Auto Changeover" button on the app secondary card. The changeover mechanism may automatically trigger changes to the system switch between Heat and Cool. The user may override the auto changeover by changing the system switch. One touch actions and automatic actions may override the auto changeover by changing the system switch. An override may persist until the changeover mechanism retriggers or the user presses the "Auto Changeover" button on the app secondary card. At the thermostat, the user cannot necessarily tell whether the auto changeover has been activated. If the system switch is Off while the auto changeover is active, then it may trigger to automatically have a change between Heat and Cool be disabled until the system switch changes to Heat or Cool.

To recap, a thermostat may incorporate a cool mode and heat mode mechanism having a connection for controlling a building heating and cooling system for affecting a temperature of a space, a temperature setpoint mechanism, having cool and heat setpoints that are adjustable, connected to the cool mode and heat mode mechanism, and an auto changeover connected to the temperature setpoint mechanism. The building heating and cooling system may be a heating, ventilation and air conditioning (HVAC) system.

The auto changeover may switch the thermostat from one mode to another mode according to the temperature of the space for a set amount of time relative to the cool and heat setpoints and hystereses above and below the cool and heat setpoints, respectively. The auto changeover may occur when a cool setpoint is less than a heat setpoint. The auto changeover may occur when cool and heat setpoints are the same. The auto changeover may occur when a cool setpoint is greater than a heat setpoint.

The auto changeover may switch from a heat mode to a cool mode when the temperature of the space is X degrees F. or more above the heat setpoint for W minutes of time. The auto changeover may switch from the cool mode to the heat mode when the space temperature of the space is Y degrees F. or more below the cool setpoint for Z minutes of time. X may range from 0.0 to virtually any number. Y may range from 0.0 to virtually any number. X may vary with time and Y may vary with time. X and Y are not necessarily the same number. W may range from 0.0 to virtually any number and Z may range from 0.0 to virtually any number. W may vary with time and Z may vary with time. W and Z are not necessarily the same number.

The thermostat may further incorporate a user interface having a display. The display may show a mode which automatically changes between heat and cool to indicate the mode of the thermostat.

If the mode is unknown and the temperature of the space is below the heat setpoint and the cool setpoint, then the auto changeover may start in a heat mode, or if the mode is unknown and the temperature of the space is above the heat setpoint and the cool setpoint, then the auto changeover may start in a cool mode, or if the mode is unknown and the temperature of the space is between the heat setpoint and the cool setpoint, then the auto changeover may start in the mode of whichever setpoint is closest to the space temp.

The auto changeover may be overridden by manually selecting a heat mode or a cool mode. The auto changeover may be reinstated by a manual retrigger, a time-out retrigger, or a retrigger of conditions that cause switching between the heat mode and the cool mode.

A thermostat for a heating, ventilation and air conditioning system of a building, may incorporate a user interface, and an auto changeover connected to the user interface, for switching from one mode to another mode according to the temperature of the space at a set amount of time relative to a cool setpoint or heat setpoint, and having adjustable hystereses above and below the cool and heat setpoints. The user interface may display a mode of the thermostat and automatically indicate a heat or cool mode that is in effect.

The user interface may have a provision for one or more one touch actions. A one touch action may be a user defined set of operations carried out across one or more devices at a press of a button switch. A one touch action of a button switch may actuate multiple device specific actions. A one touch action of a button switch for control of the temperature of the space may incorporate setting a heat setpoint and a cool setpoint. The heat setpoint may be greater or less than the cool setpoint, or equal to the cool setpoint.

A one touch action may be an automatic action. An automatic action may incorporate a time or trigger, and an optimal enable condition. Triggers and enable conditions may be evaluated as to be true or false. An automatic action that is time based may have a specific time. An automatic action that is triggered may have an evaluation of true or false. When a trigger changes from false to true, then an action list may be executed. Once the action list is executed, to execute the action list again, the evaluation of the trigger may need to change back to false and then to true. The action list may incorporate energizing a heating, ventilation and air conditioning (HVAC) piece of equipment.

A one touch action can be an automatic action. The automatic action may incorporate a time or trigger, and an optimal enable condition. Triggers and enable conditions may be evaluated as to be true or false. A trigger may be a temperature.

A parameter of the automatic action may be manually changed, and be an override of the automatic action. The override may persist until an associated automatic action is triggered.

The thermostat may further incorporate an action button for executing virtually all automatic actions having triggers that have an evaluation of true. The action button may give a user an ability to cancel overrides of triggers of automatic actions.

A setpoint may be shown at the user interface when a mode is shown. When a system switch is on a heat mode, the setpoint may be a heat setpoint, and the heat setpoint may be modified by manually changing the setpoint shown. When the system switch is on a cool mode, the setpoint may be a cool setpoint, and the cool setpoint may be modified by manually changing the setpoint shown. When the system switch is at off, then no setpoint is necessarily shown and the heat setpoint or the cool setpoint cannot necessarily be manually changed.

The auto changeover may be virtually always allowed. The auto changeover may be manually deactivated and activated.

The thermostat may further incorporate an emergency heat component having a button to activate emergency heat. When the emergency heat is activated, a system switch may automatically change the thermostat to heat and the auto changeover may be automatically deactivated. When the auto changeover is activated, the emergency heat may be deactivated. When the system switch is changed to cool or off, the emergency heat may be automatically deactivated.

A thermostat system may incorporate a thermostat hardware device. The thermostat hardware device may incorporate a cool mode and heat mode mechanism having a connection for controlling a building heating and cooling system for affecting a temperature of a space, a temperature setpoint mechanism, having cool and heat setpoints that are adjustable, connected to the cool mode and heat mode mechanism, and an auto changeover connected to the temperature setpoint mechanism.

The auto changeover may switch the thermostat from one mode to another mode according to the temperature of the space relative to the cool and heat setpoints. The cool setpoint may be greater or less than, or equal to the heat setpoint.

The cool and heat setpoints may be situated between zero and any number of degrees F. apart from each other.

The thermostat system may further incorporate a mobile application, and a cloud connected to the mobile application and the thermostat hardware device.

The auto changeover may switch from the heat mode to the cool mode when the temperature of the space is X degrees F. or more above the heat setpoint and after transitioning for a period of Y minutes at the temperature of the space of X degrees F. or more above the heat setpoint. The auto changeover may switch from the cool mode to the heat mode when the space temperature of the space is X degrees F. or more below the cool setpoint and after transitioning for a period of Y minutes at the temperature of the space of X degrees F. or more below the cool setpoint. X may range from zero to virtually any number and Y may range from zero to virtually any number. X and Y for switching to the cool mode are not necessarily the same as X and Y for switching to the heat mode.

A thermostat may incorporate a cool mode and heat mode mechanism having a connection for controlling a building heating and cooling system for affecting a temperature of a space, a temperature setpoint mechanism connected to the cool mode and heat mode mechanism, a user interface mechanism for the user to select between the heat and cool modes and to view the mode that has been selected, and an auto mechanism to automatically change between heat and cool modes without user action. The user interface mechanism may be used for separately viewing a manually selected mode and an automatically selected mode.

The auto mechanism may switch from a heat mode to a cool mode when the temperature of the space is X degrees F. or more above a heat setpoint for W minutes of time. The auto mechanism may switch from the cool mode to the heat mode when the space temperature of the space is Y degrees F. or more below a cool setpoint for Z minutes of time.

The following patent documents may be of interest relative to the present application. U.S. patent application Ser. No. 12/881,058, filed Sep. 13, 2010, and entitled "Automatic Changeover Control for an HVAC System", is hereby incorporated by reference. U.S. patent application Ser. No. 12/886,925, filed Sep. 21, 2010, and entitled "Remote Control of an HVAC System that Uses a Common Temperature Setpoint for both Heat and Cool Modes", is hereby incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A thermostat comprising:

a cool mode and heat mode mechanism having a connection for controlling a building heating and cooling system for affecting a temperature of a space;

a temperature setpoint mechanism, having cool and heat setpoints that are adjustable, connected to the cool mode and heat mode mechanism; and an auto changeover connected to the temperature setpoint mechanism; and wherein:

the auto changeover is configured to switch the thermostat from one mode to another mode according to the temperature of the space for a set amount of time relative to the cool and heat setpoints and hystereses above and below the cool and heat setpoints, respectively;

the auto changeover is configured to occur at each of the cool setpoint is less than the heat setpoint, the cool and heat setpoints are the same, and the cool setpoint is greater than the heat setpoint.

2. The thermostat of claim 1, wherein:

the auto changeover switches from a heat mode to a cool mode when the temperature of the space is X degrees F. or more above the heat setpoint for W minutes of time; and the auto changeover switches from the cool mode to the heat mode when the temperature of the space is Y degrees F. or more below the cool setpoint for Z minutes of time.

3. The thermostat of claim 2, wherein:

X ranges from 0.0 to virtually any number;

Y ranges from 0.0 to virtually any number;

X can vary with time;

Y can vary with time;

X and Y are not necessarily the same number;

W ranges from 0.0 to virtually any number;

Z ranges from 0.0 to virtually any number;

W can vary with time;

Z can vary with time; and

W and Z are not necessarily the same number.

4. The thermostat of claim 1, further comprising:

a user interface having a display; and wherein the display shows a mode which automatically changes between heat and cool to indicate the mode of the thermostat.

5. The thermostat of claim 1, wherein:

if a mode is unknown and the temperature of the space is below the heat setpoint and the cool setpoint, then the auto changeover will start in a heat mode;

if the mode is unknown and the temperature of the space is above the heat setpoint and the cool setpoint, then the auto changeover may start in a cool mode; or if the mode is unknown and the temperature of the space is between the heat setpoint and the cool setpoint, then the auto changeover may start in the mode of whichever setpoint is closest to the temperature of the space.

6. The thermostat of claim 1, wherein:

the auto changeover can be overridden by manually selecting a heat mode or a cool mode; and the auto changeover can be reinstated by a manual retrigger, a time-out retrigger, or a retrigger of conditions that cause switching between the heat mode and the cool mode.

7. The thermostat of claim 1, wherein the building heating and cooling system is a heating, ventilation and air conditioning (HVAC) system.

8. A thermostat system comprising:

a thermostat hardware device; and wherein:

the thermostat hardware device comprises:

a cool mode and heat mode mechanism having a connection for controlling a building heating and cooling system for affecting a temperature of a space;

a temperature setpoint mechanism, having cool and heat setpoints that are adjustable, connected to the cool mode and heat mode mechanism; and an auto changeover connected to the temperature setpoint mechanism; and wherein:

the auto changeover is configured to switch the thermostat from one mode to another mode according to the temperature of the space relative to the cool and heat setpoints; and the auto changeover occurs at each of the cool setpoint greater than, less than, and equal to the heat setpoint.

9. The system of claim 8, may further comprise a mobile application; and a cloud connected to the mobile application and to the thermostat hardware device.

10. The system of claim 8, wherein the cool and heat setpoints are situated between zero and any number of degrees F. apart from each other.

11. The system of claim 8, wherein:

the auto changeover switches from a heat mode to a cool mode when the temperature of the space is X degrees F. or more above the heat setpoint and after transitioning for a period of Y minutes at the temperature of the space of X degrees F. or more above the heat setpoint; and the auto changeover switches from the cool mode to the heat mode when the temperature of the space is X degrees F. or more below the cool setpoint and after transitioning for a period of Y minutes at the temperature of the space of X degrees F. or more below the cool setpoint;

X ranges from zero to virtually any number;

Y ranges from zero to virtually any number; and

X and Y for switching to the cool mode are not necessarily the same as X and Y for switching to the heat mode.

12. A thermostat device for a heating, ventilation and air conditioning system of a building, comprising:

a user interface;

a controller configured to receive inputs from the user interface and to activate or deactivate one or more components of a heating, ventilation, and air conditioning system of a building;

an auto changeover connected to the controller, for switching from one mode to another mode according to a temperature of a space at a set amount of time relative to a time a temperature controlled space reaches a cool setpoint or heat setpoint, and having adjustable hystereses above and below the cool and heat setpoints, respectively; and wherein:

the user interface displays a mode of the thermostat device and automatically indicates a heat or cool mode that is in effect; and the cool setpoint is different from the heat setpoint and a minimum deadband is not required between the cool setpoint and the heat setpoint;

the user interface has a provision for receiving one or more one touch actions;

a one touch action is a user defined set of operations carried out across one or more devices at a press of a button switch; and the one or more touch actions comprise a one touch action of a button switch actuates multiple device specific actions or a one touch action of a button switch for control of the temperature of the space comprises setting the heat setpoint and the cool setpoint;

a one touch action is an automatic action comprising a trigger to execute an action list, wherein the trigger is either true or false when a trigger changes from false to true, then the action list is executed;

once the action list is executed, to execute the action list again, the trigger needs to change back to false and then to true; and the action list comprises energizing a heating, ventilation and air conditioning (H-VAC) piece of equipment.

13. The device of claim 12, wherein:

a one touch action is an automatic action;

the automatic action comprises a time or trigger, and an optimal enable condition;

triggers and enable conditions are either true or false; and a trigger is a temperature.

14. The device of claim 13, wherein if a parameter of the automatic action is manually changed it overrides the automatic action.

15. The device of claim 14, further comprising:

an action button for executing all automatic actions having triggers that have an evaluation of true; and wherein the action button gives a user an ability to cancel overrides of triggers of automatic actions.

16. The device of claim 12, wherein:

a setpoint is shown at the user interface when the mode is shown;

when a system switch is on the heat mode, the setpoint is the heat setpoint, and the heat setpoint can be modified by manually changing the setpoint shown;

when the system switch is on the cool mode, the setpoint is the cool setpoint, and the cool setpoint can be modified by manually changing the setpoint shown; and when the system switch is at off, then no setpoint is shown and the heat setpoint or the cool setpoint cannot be manually changed.

17. The device of claim 12, wherein:

the auto changeover is always allowed; and the auto changeover can be manually deactivated and activated.

18. The device of claim 17, further comprising:

an emergency heat component having a button to activate emergency heat; and wherein:

when the emergency heat is activated, a system switch automatically changes the thermostat device to heat and the auto changeover is automatically deactivated;

when the auto changeover is activated, the emergency heat is deactivated; and when the system switch is changed to cool or off, the emergency heat is automatically deactivated.

* * * * *